US007944134B2

(12) United States Patent
Kyuno et al.

(10) Patent No.: US 7,944,134 B2
(45) Date of Patent: May 17, 2011

(54) SPARK PLUG WITH CENTER ELECTRODE HAVING HIGH HEAT DISSIPATION PROPERTY

(75) Inventors: Jiro Kyuno, Kiyosu (JP); Akira Suzuki, Nagoya (JP); Mai Moribe, Inazawa (JP); Yuichi Nakano, Nagoya (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 238 days.

(21) Appl. No.: 12/275,259

(22) Filed: Nov. 21, 2008

(65) Prior Publication Data

US 2009/0127998 A1 May 21, 2009

(30) Foreign Application Priority Data

Nov. 21, 2007 (JP) ..... 2007-301852

(51) Int. Cl.
*H01T 13/16* (2006.01)
*H01T 13/20* (2006.01)
*H01T 13/39* (2006.01)

(52) U.S. Cl. ..... 313/141; 313/144; 313/145; 123/169 R; 123/169 EL

(58) Field of Classification Search ..... 313/141–145; 123/169 R, 169 EL
See application file for complete search history.

(56) References Cited

U.S. PATENT DOCUMENTS

| | | | | |
|---|---|---|---|---|
| 4,659,960 | A * | 4/1987 | Toya et al. | 313/141 |
| 6,265,816 | B1 * | 7/2001 | Ito et al. | 313/141 |
| 6,528,929 | B1 * | 3/2003 | Matsutani et al. | 313/141 |
| 6,864,622 | B2 * | 3/2005 | Matsutani et al. | 313/141 |
| 7,382,084 | B2 * | 6/2008 | Yoshimoto et al. | 313/141 |
| 7,569,978 | B2 * | 8/2009 | Tinwell | 313/141 |
| 2006/0113883 | A1 | 6/2006 | Kanao | |

FOREIGN PATENT DOCUMENTS

| | | | |
|---|---|---|---|
| JP | 5-159853 | A | 3/1999 |
| JP | 2006-156110 | A | 6/2006 |

OTHER PUBLICATIONS

Notification of Reasons for Refusal issued Dec. 21, 2010 in counterpart Japanese Application No. 2007-301852.

* cited by examiner

*Primary Examiner* — Sikha Roy
(74) *Attorney, Agent, or Firm* — Sughrue Mion, PLLC

(57) ABSTRACT

A spark plug including: a center electrode including an electrode base member and a core member; an electrode tip joined to the center electrode via a molten bond; an insulator holding the center electrode; a metal shell holding the insulator; and a ground electrode joined to the metal shell. Relationships $d \leqq 2.1$ [mm] and $-0.09 \times d + 0.33 < Vb/(Va+Vb) < -0.2 \times d + 0.75$ are satisfied, where d is an outer diameter of the center electrode at a position 4 mm closer to the base end of the center electrode from the base end of the molten bond in the axial direction, and Va and Vb are volumes of the electrode base member and the core member, respectively, at a region between the base end of the molten bond and the position in the axial direction.

5 Claims, 13 Drawing Sheets

SPARK PLUG WITH CENTER ELECTRODE HAVING HIGH HEAT DISSIPATION PROPERTY

BACKGROUND OF THE INVENTION

1. Field of the Invention

The present invention relates to a spark plug mountable in an internal combustion engine and configured to ignite an air-fuel mixture.

2. Description of the Related Art

A spark plug for ignition has been used in an internal combustion engine. A spark plug generally includes a center electrode, an insulator holding the center electrode in an axial hole, a metal shell surrounding and holding the radial periphery of the insulator, a ground electrode having an end joined to the metal shell and another end defining a spark discharge gap between the center electrode and the ground electrode. A spark discharge is carried out between the center electrode and the ground electrode, thus igniting an air-fuel mixture. In the spark plug, to prevent the wear and tear of the electrodes resulting from the spark discharge, an electrode tip containing a noble metal as a main component is joined to at least one of the center electrode and the ground electrode (see JP-A-5-159853, for example).

In the spark plug described in JP-A-5-159853, a hole is bored in a leading end surface of the center electrode; the electrode tip is fitted thereto; and thereafter the electrode tip and the center electrode are welded together. A metallic core (core member) having a high thermal conductance, such as copper or silver, is embedded in the center electrode, and the core member contacts or is located close to the electrode tip fitted to the hole. The core member can efficiently improve the heat dissipation at a leading end portion of the center electrode.

However, when the diameter of the spark plug is reduced so as to secure the degree of freedom of engine design in order to heighten the output of an automobile engine or to save fuel cost, the diameter of the center electrode will also be reduced. In turn, the cross-sectional area of the core member will become small. Therefore, the heat dissipation property may be lowered. Further, JP-A-5-159853 requires an extra process for forming a hole, to which the electrode tip is fitted in the leading end surface of the center electrode. If the electrode tip and the center electrode are joined together without forming this hole, due to a decrease in heat dissipation property as mentioned above, the heat dissipation property of a molten bond formed by welding these two elements will not be sufficient. Consequently, the molten bond may oxidize at a high temperature when the engine is heavily loaded, and hence the joining capability of the electrode tip may be lowered.

SUMMARY OF THE INVENTION

The present invention was made in consideration of the above circumstances, and an object thereof is to provide a spark plug capable of sufficiently maintaining the heat dissipation property of the leading end portion of the center electrode and reliably preventing oxidation of the molten bond formed between the center electrode and the electrode tip joined to the leading end portion of the center electrode.

In a first aspect, the above object of the present invention has been achieved by providing a spark plug comprising: a center electrode extending from a leading end thereof to a base end thereof in an axial direction and comprising an electrode base member and a core member disposed inside the electrode base member, the core member having a thermal conductance higher than that of the electrode base member; an electrode tip containing a noble metal as a main component, the electrode tip joined to a leading end portion of the center electrode via a molten bond in which the electrode tip and the center electrode are fused, the molten bond extending from a leading end thereof to a base end thereof in the axial direction; an insulator having an axial hole extending in the axial direction, the insulator holding the center electrode in the axial hole on a leading end side portion of the axial hole; a metal shell extending from a leading end thereof to a base end thereof in the axial direction and surrounding and holding a radial periphery of the insulator; and a ground electrode having one end joined to a leading end surface of the metal shell and another end defining a spark discharge gap between the electrode tip and the ground electrode; wherein the following relationships $d \leqq 2.1$ [mm] and $-0.09 \times d + 0.33 < Vb/(Va+Vb) < -0.2 \times d + 0.75$ are satisfied, where: d is an outer diameter of the center electrode at a position 4 mm closer to the base end of the center electrode from the base end of the molten bond in the axial direction; Va and Vb are volumes of the electrode base member and the core member, respectively, in a region from the base end of the molten bond to a position of the center electrode 4 mm closer to the base end of the center electrode from the base end of the molten bond in the axial direction.

In a second aspect, the present invention provides a spark plug according to the first aspect, wherein the core member of the center electrode has a linear expansion coefficient of $25 \times 10^{-6}$ [1/K] or less at 800° C.

In a third aspect, the present invention provides a spark plug according to the first or second aspects, wherein the base end of the molten bond is located 1 mm or more closer to the leading end of the center electrode than the leading end surface of the metal shell in the axial direction.

In a fourth aspect, the present invention provides a spark plug according to any one of the first to third aspects, wherein a distance defined between the base end of the molten bond and a leading end of the core member in the axial direction is 0.5 mm or less.

In a fifth aspect, the present invention provides a spark plug according to any one of the first to fourth aspects, wherein an outer circumferential surface of the metal shell has a fixing screw portion, the fixing screw portion having a threaded portion to be screwed to a fixing screw hole of an internal combustion engine, and wherein the fixing screw portion has a nominal outer diameter of 12 mm or less.

In the spark plug according to the first aspect of the present invention, the ratio $Vb/(Va+Vb)$ of the volume Vb of the core member to the volume Va+Vb of the center electrode satisfies $-0.09 \times d + 0.33 < Vb/(Va+Vb)$, and hence the core member can provide the center electrode with a sufficient heat dissipation property. In this manner, the volume ratio of the core member relative to the outer diameter d of the center electrode can be set such that the temperature of the molten bond does not reach 950° C. so as to fully prevent the molten bond from becoming oxidized, and so as to prevent loss or rather peeling off of the electrode tip due to oxidation of the molten bond.

Additionally, in the spark plug according to the first aspect of the present invention, the ratio $Vb/(Va+Vb)$ of the volume Vb of the core member satisfies $Vb/(Va+Vb) < -0.2 \times d + 0.75$, and hence it is possible to reduce stress generated between the core member and the electrode base member due to a difference in thermal expansion between the core member and the electrode base member. Therefore, the internal stress of the center electrode can be controlled so as not to unduly increase, and breakage or deformation of the electrode base member can be prevented.

Further, the first aspect of the present invention is applied to a spark plug including a center electrode having an outer diameter d of 2.1 mm or less requiring a high heat dissipation property, and hence the spark plug can assume a reduced size and diameter while sufficiently ensuring adequate heat dissipation property of the center electrode by setting the ratio Vb/(Va+Vb) of the volume Vb of the core member as described above.

According to the second aspect of the invention, a material having a coefficient of linear expansion of $25\times10^{-6}$ [1/K] or less at 800° C. is used as the core member. Therefore, stress from the core member imparted to the electrode base member arranged on an outer side of the core member due to a difference in thermal expansion coefficients thereof can be reduced, and the breakage or deformation of the electrode base member can be prevented.

Another consideration is that ignitability of an air-fuel mixture can increase as the spark discharge gap defined between the ground electrode and the electrode tip of the center electrode protrudes further into a combustion chamber of an internal combustion engine. On the other hand, the center electrode provided in such spark plug requires a higher heat dissipation property. However, if the center electrode has a high heat dissipation property as mentioned above, such center electrode can also be used for a spark plug in which the base end of the molten bond is located 1 mm or more closer to the leading end of the plug in the axial direction than the leading end surface of the metal shell as in the spark plug according to the third aspect of the present invention. Thus, ignitability can be improved while sufficiently ensuring the heat dissipation property of the center electrode.

According to the fourth aspect of the invention, the distance defined between the base end of the molten bond and a leading end of the core member in the axial direction is 0.5 mm or less. Therefore, the heat dissipation property of the center electrode can be further improved.

If a center electrode as described above having an improved heat dissipation property is used for a spark plug of reduced size, especially a spark plug in which the nominal diameter of the threaded portion of the fixing screw portion is 12 mm or less as in the spark plug according to the fifth aspect of the present invention, insulation properties can be maintained while securing the thickness of the insulator. Further, horizontal sparking can be prevented while securing a clearance between an inner periphery of the metal shell and an outer periphery of the insulator, and hence a more advantageous effect can be achieved.

DESCRIPTION OF THE EMBODIMENTS

Figure 1:
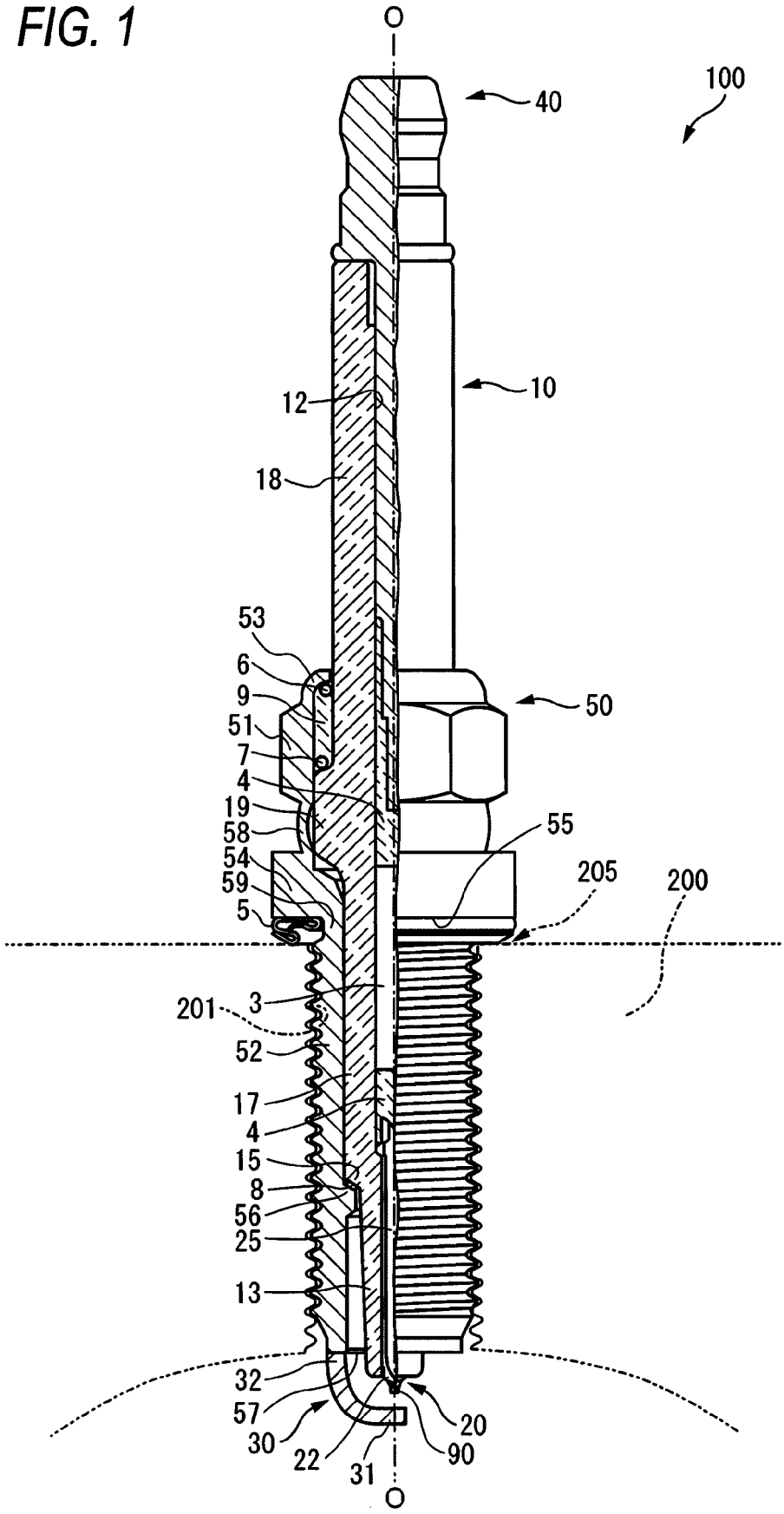
FIG. 1 is a partial sectional view of a spark plug according to an embodiment of the invention.
Figure 2:
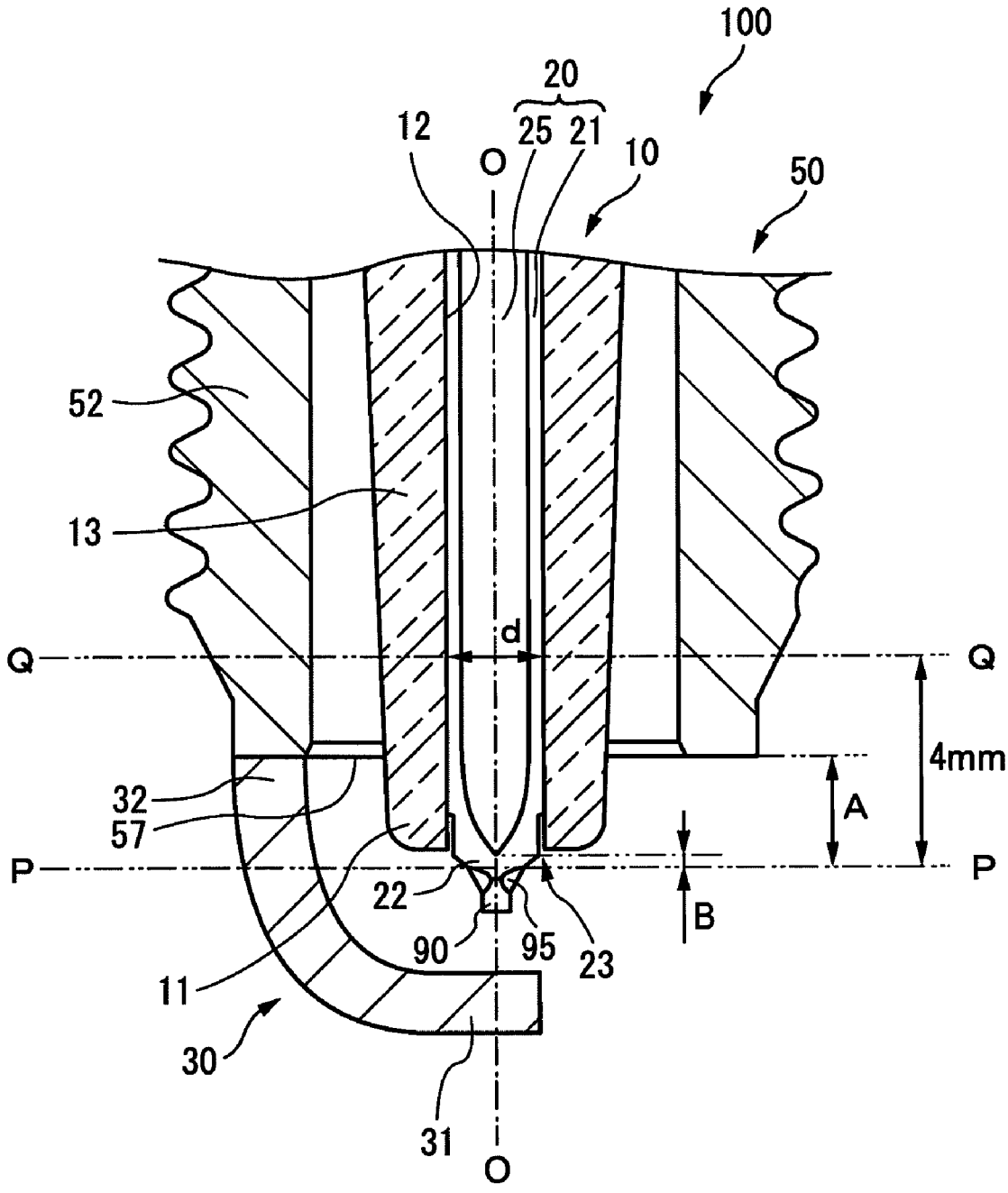
FIG. 2 is an enlarged sectional view of an area near a leading end portion of a center electrode of the spark plug.

An embodiment of a spark plug of the present invention will be hereinafter described with reference to the drawings. However, the present invention should not be construed as being limited thereto. Referring first to FIGS. 1 and 2, the structure of the spark plug 100 will be described as one example. FIG. 1 is a partial sectional view of the spark plug 100. FIG. 2 is an enlarged sectional view of an area near a leading end portion of a center electrode of the spark plug. In the following description, a direction of an axis line O of the spark plug 100 (also referred to as an axial direction) corresponds to a vertical direction in FIG. 1, in which a lower side of FIG. 1 corresponds to a leading end side of the spark plug, and the upper side of FIG. 1 corresponds to a base end side of the spark plug.

As shown in FIG. 1, a spark plug 100 includes an insulator 10, a metal shell 50 holding the insulator 10, a center electrode 20 held in a direction of an axis line O in the insulator 10, a ground electrode 30 having a basal portion 32 welded to a leading end surface 57 of the metal shell 50 and a distal end portion 31 whose side surface faces a leading end portion 22 of the center electrode 20, and a terminal metal fitting 40 provided at a base end portion of the insulator 10.

First, the insulator 10 serving as an insulating member of the spark plug 100 will be described. As is well known to those of ordinary skill in this field of art, the insulator 10 is formed by sintering alumina or the like, and has a cylindrical shape in which an axial hole 12 extending around the axis line O and in the direction of the axis line O is formed. A flange portion 19 having the greatest outer diameter is formed substantially in the center in the direction of the axis line O. A base end side barrel portion 18 is formed closer to a base end (i.e., upper side in FIG. 1) than the flange portion 19. A leading end side barrel portion 17 smaller in outer diameter than the base end side barrel portion 18 is formed closer to a leading end (i.e., lower side in FIG. 1) than the flange portion 19. Additionally, a leg portion 13 smaller in outer diameter than the leading end side barrel portion 17 is formed closer to the leading end than the leading end side barrel portion 17. The leg portion 13 has a reduced diameter toward its leading end, and is exposed to a combustion chamber of an internal combustion engine when the spark plug 100 is attached to an engine head 200 of the internal combustion engine. A step portion 15 is formed between the leg portion 13 and the leading end side of the barrel portion 17.

Next, the center electrode 20 will be described. As shown in FIG. 2, the center electrode 20 is rod-shaped and includes an electrode base member 21 and a core member 25. The electrode base member contains nickel or an alloy containing nickel as a main component thereof such as INCONEL (trade name) 600 or 601. The core member 25 is embedded in the electrode base member 21 and contains copper or an alloy containing copper as main component which has a thermal conductance higher than that of the electrode base member 21. Normally, the center electrode 20 is formed by filling the inside of the electrode base member 21 formed into a bottomed cylinder shape with the core member 25 and then elongating while performing extrusion molding from the bottom side. The core member 25 has a substantially fixed outer diameter at the barrel portion, and the diameter of the core member 25 is reduced toward the leading end side.

The leading end portion 22 of the center electrode 20 protrudes more toward the leading end side than the leading end portion 11 of the insulator 10, and the diameter of the leading end portion 22 is reduced toward the leading end. An electrode tip 90 containing a noble metal as a main component is joined to the leading end surface of the leading end portion 22 of the center electrode 20. In this embodiment, the "main component" contained in an element (e.g., the electrode tip 90) means a component contained in an amount of 50 wt % or more in the element. The electrode tip can improve spark wear resistance. The electrode tip 90 and the leading end portion 22 of the center electrode 20 are welded together by laser welding around an entire circumference of an interface between the electrode tip 90 and the leading end portion 22 of the center electrode 20. The laser irradiation during the laser welding forms a molten bond 95 in which materials of the electrode tip 90 and the center electrode 20 are melted and mixed together, which firmly join the electrode tip 90 and the center electrode 20. A slight gap 23 is formed between an inner circumferential surface of the axial hole 12 in the leading end portion 11 of the insulator 10 and the outer circumferential surface of the center electrode 20 facing the inner circumferential surface of the axial hole 12. The gap reduces a load imposed on the leading end portion 11 of the insulator 10 by expansion of the leading end portion 22 of the center electrode 20 due to a cold-hot cycle. The center electrode 20 extends toward the base end in the axial hole 12, and is electrically connected to the terminal metal fitting 40 situated on the base end side (i.e., upper side in FIG. 1) via a seal body 4 and a ceramic resistor 3 (see FIG. 1). A high-tension cable (not shown) is connected to the terminal metal fitting 40 via a plug cap (not shown) so that a high voltage is applied thereto.

Next, the ground electrode 30 will be described. The ground electrode 30 is made of metal having high corrosion resistance. As an example, a nickel alloy such as INCONEL (trade name) 600 or 601 is used for the ground electrode 30. The ground electrode 30 has a substantially rectangular shape in cross section perpendicular to its longitudinal direction. The base portion 32 of the ground electrode 30 is joined to the leading end surface 57 of the metal shell 50 by welding. The distal portion 31 of the ground electrode 30 is bent so that one side surface of the distal portion 31 faces the leading end portion 22 of the center electrode 20.

Next, the metal shell 50 will be described. As shown in FIG. 1, the metal shell 50 is a cylindrical metal shell used to fix the spark plug 100 to the engine head 200 of the internal combustion engine. The metal shell 50 holds the insulator 10 therein to surround the insulator 10 from a part of the base end side barrel portion 18 to the leg portion 13. The metal shell 50 is made of low-carbon steel, and includes a tool engaging portion 51 for engaging a spark plug wrench (not shown) and a fixing screw portion 52 having a threaded portion to be screwed into a fixing screw hole 201 of the engine head 200 disposed at an upper portion of the internal combustion engine.

A flange-shaped seal portion 54 is formed between the tool engaging portion 51 and the fixing screw portion 52 of the metal shell 50. An annular gasket 5 formed by bending a plate body is fitted to a screw neck 59 disposed between the fixing screw portion 52 and the seal portion 54. When the spark plug 100 is attached to the engine head 200, the gasket 5 is pressed and deformed between a bearing surface 55 of the seal portion and an opening peripheral edge portion 205 of the fixing screw hole 201 and seals a space between the bearing surface 55 and the opening peripheral edge portion 205. Accordingly, the gasket 5 can prevent gas leakage from inside the engine through the fixing screw hole 201.

The metal shell 50 includes a thin crimping portion 53 at a position closer to the base end than the tool engaging portion 51. Also, the metal shell 50 includes a thin buckling portion 58 similar to the crimping portion 53 between the seal portion 54 and the tool engaging portion 51. Annular ring members 6 and 7 are interposed between the inner circumferential surface of the metal shell 50 and the outer circumferential surface of the base end side barrel portion 18 of the insulator 10 at a region from the tool engaging portion 51 to the crimping portion 53. A space between the ring members 6 and 7 is filled with talc powder 9. The insulator 10 is pressed to the leading end side in the metal shell 50 through the ring members 6 and 7 and the talc powder 9 by bending and crimping the crimping portion 53 inwardly. As a result, the step portion 15 of the insulator 10 is supported by a step portion 56 formed at the position of the fixing screw portion 52 at the inner periphery of the metal shell 50 via an annular plate packing 8 provided between the step portion 15 and the step portion 56, and the metal shell 50 and the insulator 10 are combined together. At this time, airtightness between the metal shell 50 and the insulator 10 is maintained by the plate packing 8, and combustion gas is prevented from leaking out. The buckling portion 58 is bent and deformed outwardly by applying a compressing force when crimped, and the compression stroke of the talc powder 9 is worked, so that the airtightness of the inside of the metal shell 50 is improved.

In the spark plug 100, the leading end portion 22 of the center electrode 20 and the electrode tip 90 are cooled by heat dissipation. That is, the heat of the center electrode 20 or of the electrode tip 90 caused by operation of the engine is conducted through the core member 25 having a high thermal conductance and is released to the base end side of the center electrode 20. The heat dissipation is reliably performed, and the molten bond 95 formed by joining the electrode tip 90 and the center electrode 20 does not reach a temperature at which oxidization easily occurs. To perform the heat dissipation reliably and efficiently, in the spark plug 100 of the present embodiment, the relationship between diameters and volumes of components of the center electrode 20, i.e., the electrode base member 21 and the core member 25, is set as described below.

First, in the present embodiment, the outer diameter d of the center electrode 20, the volume Va of the electrode base member 21, and the volume Vb of the core member 25 are set using a reference position that is located 4 mm closer to the base end side in the direction of the axis line O from a most rearward base end position of the molten bond 95 in the direction of the axis line O (also referred to as a base end of the molten bond 95). The reason is that, from the results of Example 1 described below, among samples of the center electrode 20 having different volume ratios among the electrode base member 21 and the core member 25, a great difference in temperature distribution was not found in a region closer to the base end of the plug than the reference position (i.e., a position 4 mm closer to the base end of the center electrode from the base end of the molten bond 95). In other words, the volume ratio between the volume Va of the electrode base member 21 and the volume Vb of the core member 25 at a region from the base end of the molten bond 95 to the position 4 mm away therefrom toward the base end side in the direction of the axis line O strongly influences the heat dissipation property of the center electrode 20.

Figure 3:
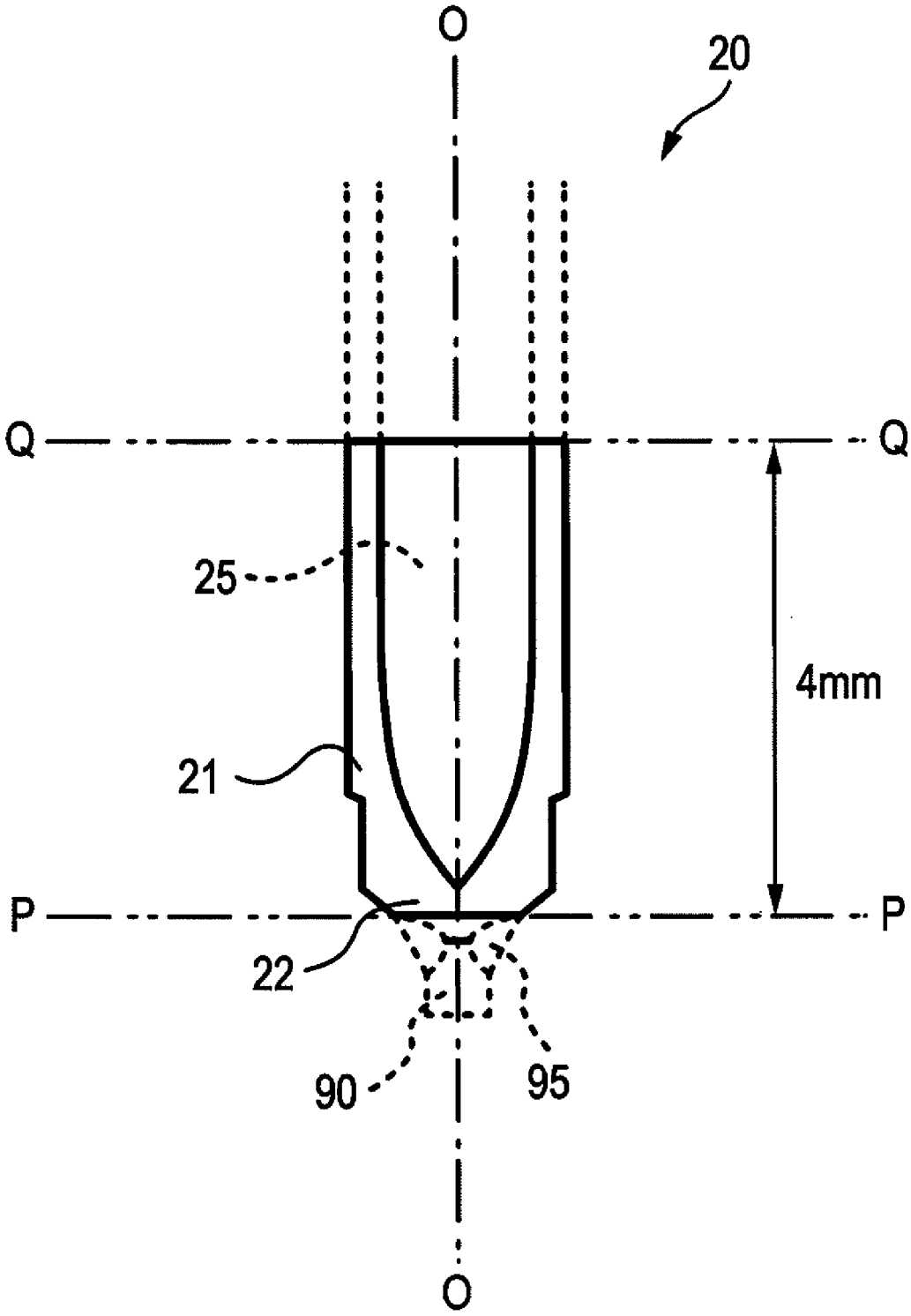
FIG. 3 is a sectional view of an electrode base member in a region between a base end of a molten bond and a position 4 mm closer to the base end portion of the center electrode than the base end of the molten bond in an axial direction.
Figure 4:
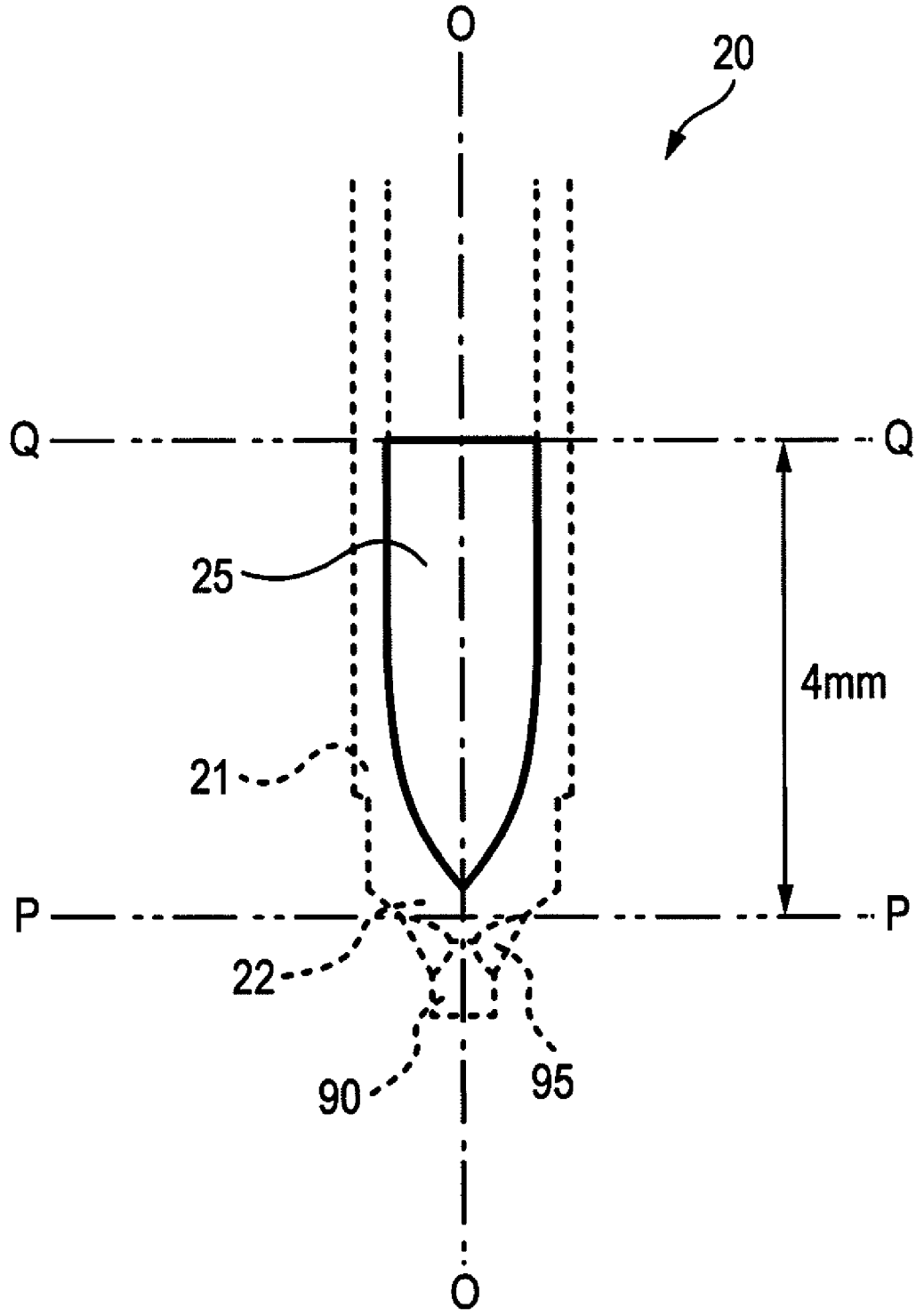
FIG. 4 is a sectional view of a core member in a region between the base end of the molten bond and a position 4 mm closer to the base end of the center electrode than the base end of the molten bond in the axial direction.

In the embodiment, as shown in FIG. 2, a plane P (the cross-section thereof is shown by a two-dot chain line P-P) is defined as a plane that passes through the base end of the molten bond 95 and that is perpendicular to the axis line O. Additionally, a plane Q (cross-section thereof is shown by a two-dot chain line Q-Q) is defined as a plane that passes through a position 4 mm away from the position of the plane P toward the base end side in the direction of the axis line O and that is perpendicular to the axis line O. Next, the center electrode 20 is cut along the planes P and Q for illustrative purposes. At this time, a volume Va is defined as a volume of the electrode base member 21 of the center electrode 20 cut along the planes P and Q as shown in FIG. 3. Also, a volume Vb is defined as a volume of the core member 25 of the center electrode 20 cut along the planes P and Q as shown in FIG. 4. Further, as shown in FIG. 2, a diameter d is defined as a diameter of the surface of the center electrode 20 obtained by cutting along the plane Q, i.e., the outer diameter of the center electrode 20, at a position 4 mm closer to the base end of the plug than the base end of the molten bond 95 in the direction of the axis line O. The volume Vb of the core member 25 of the center electrode 20 may be determined by the following steps: performing a cross-section analysis using X-ray imaging for the center electrode at equally-spaced positions in its lengthwise direction (e.g., at 0.1 mm intervals); calculating an area covered by the core member 25 for each position; and calculating an integral value of the areas.

In the present embodiment, the outer diameter d of the center electrode 20 is set at 2.1 mm or less based on the results of Example 2 described below. The reason is that the sectional area of the core member 25 increases as the outer diameter d of the center electrode 20 increases, and the larger sectional area of the core member 25 improves its heat dissipation property. Therefore, especially when the outer diameter d of the center electrode 20 is greater than 2.1 mm, oxidation of the molten bond 95 can be sufficiently prevented independent of the diameters or volumes of the electrode base member 21 and the core member 25.

In the present embodiment, based on the results of Examples 3 and 4 described below, the ratio Vb/(Va+Vb) of the volume Vb of the core member 25 to the volume Va+Vb of the center electrode 20 (i.e., the sum of the volume Va of the electrode base member and the value Vb of the core member) is set to satisfy the following relationship (1):

$$-0.09\times d+0.33<Vb/(Va+Vb) \quad (1)$$

According to relationship (1), a sufficient heat dissipation property by the core member 25 is obtained, and the temperature of the molten bond 95 does not reach 950° C. Oxidation of the molten bond 95 is sufficiently prevented when the temperature is less than 950° C. Therefore, loss (i.e., falling-off) of the electrode tip 90 from the center electrode 20 can be prevented.

Further, in the present embodiment, based on the results of Example 5 described below, the ratio Vb/(Va+Vb) of the volume Vb of the core member 25 to the volume Va+Vb of the center electrode 20 is set to satisfy the following relationship (2).

$$Vb/(Va+Vb)<-0.2\times d+0.75 \quad (2)$$

The core member 25 made of copper or made of an alloy containing copper as a main component has a higher coefficient of linear expansion than that of the electrode base member 21 made of nickel or an alloy containing nickel as a main component. Stress imparted to the electrode base member 21 arranged on the outer side of the core member 25 becomes greater owing to a thermal expansion difference in proportion to an increase in the volume Vb of the core member 25 with respect to the volume Va+Vb of the center electrode 20. However, if the expression (2) is satisfied, an increase in this stress can be controlled so as to prevent the electrode base member 21 from being broken or deformed.

Based on the results of Example 6 described below, the core member 25 is produced by using a material whose coefficient of linear expansion at 800° C. is $25\times10^{-6}$ [1/K] or less. Copper is used in the present embodiment. However, a material satisfying this condition may be used as the core member 25 instead of copper, which can reduce stress imparted by the core member 25 to the electrode base member 21 arranged on the outer side of the core member 25 due to a difference in thermal expansion thereof, so as to prevent breakage or deformation of the electrode base member 21.

In the present embodiment, the distance "A" (see FIG. 2) in the direction of the axis line O between the position of the base end of the molten bond 95 and the position of the leading end surface 57 of the metal shell 50 is set at 1 mm or more. The reason is that, from the results of Example 7 described below, when the position of the base end of the molten bond 95 is located 1 mm or more closer to the leading end of the plug in the direction of the axis line O than the leading end surface 57 of the metal shell 50, the rate of temperature rise of the molten bond 95 tends to become higher with a change in the ratio Vb/(Va+Vb) than in a case in which the position of the base end of the molten bond 95 is located less than 1 mm closer thereto. Ignitability of an air-fuel mixture can improve as the spark discharge gap, defined between the ground electrode 30 and the electrode tip 90 of the center electrode 20, protrudes into the combustion chamber of the internal combustion engine. From the results of Example 7, when the position of the base end of the molten bond 95 is located 1 mm or more closer to the leading end of the plug in the direction of the axis line O than the leading end surface 57 of the metal shell 50, the center electrode 20 requires a higher heat dissipation property. Therefore, if the center electrode 20, which has an improved heat dissipation property, is used in the spark plug 100 as mentioned above, ignitability can be improved while sufficiently ensuring the heat dissipation property of the center electrode 20.

Therefore, although the outer diameter d of the center electrode 20 of the embodiment is thinned, oxidation of the molten bond 95 can be reliably prevented. To reduce the spark plug 100 in size, the use of the center electrode 20 of the embodiment makes it possible to reduce the outer diameter without changing the thickness of the insulator 10, and hence makes it possible to maintain the insulation properties of the insulator 10. Additionally, the clearance with the inner circumferential surface of the metal shell 50 reduced in diameter in the same manner as above is a relatively large amount of space, so as to prevent the occurrence of horizontal sparking or the like. In other words, with respect to a spark plug requiring a reduced size, especially with respect to a spark plug in which the nominal outer diameter of a threaded portion of a fixing screw portion is M12 (12 mm) or less, the use of the center electrode 20 of the present embodiment makes it possible to exert a more advantageous effect.

In the spark plug 100, evaluation tests were conducted as described below. The relationships between the diameters or volumes of components of the center electrode 20, i.e., the electrode base member 21 and the core member 25, were set so that the heat of the center electrode 20 or of the electrode tip 90 received by operating the engine could be reliably released toward the base end side of the center electrode 20.

EXAMPLE 1

Figure 5:
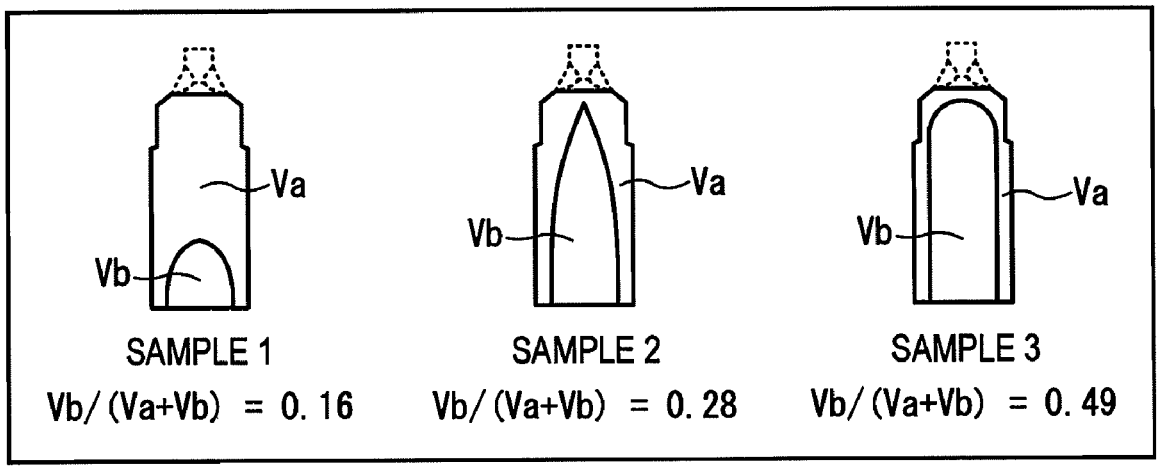
FIG. 5 is a view illustrating three kinds of center electrodes that differ in volume of the core member at a region from the base end of the molten bond to a position 4 mm away from the base end of the molten bond toward the base end side.

First, an evaluation test was made to examine the relationship between the volume of the core member 25 and the heat dissipation property of the center electrode 20. As shown in FIG. 5, three kinds of center electrodes differing in the volume of the core member contained in a region from the base end of the molten bond to a position 4 mm away from the base end of the molten bond toward the base end side were produced, and spark plug samples 1, 2 and 3 using these center electrodes, respectively, were prepared. The center electrode of sample 1 was produced while adjusting the size and shape of the electrode base member and the core member, which had not yet been subjected to extrusion molding, so that the ratio Vb/(Va+Vb) of the volume Vb of the core member to the volume Va+Vb of the center electrode in the above-mentioned part was set at 0.16. Likewise, the center electrode of sample 2 was produced so that the ratio Vb/(Va+Vb) was set at 0.28, and the center electrode of sample 3 was produced so that the ratio Vb/(Va+Vb) was set at 0.49. The outer diameter d of the center electrode was set at 1.9 mm.

Figure 6:
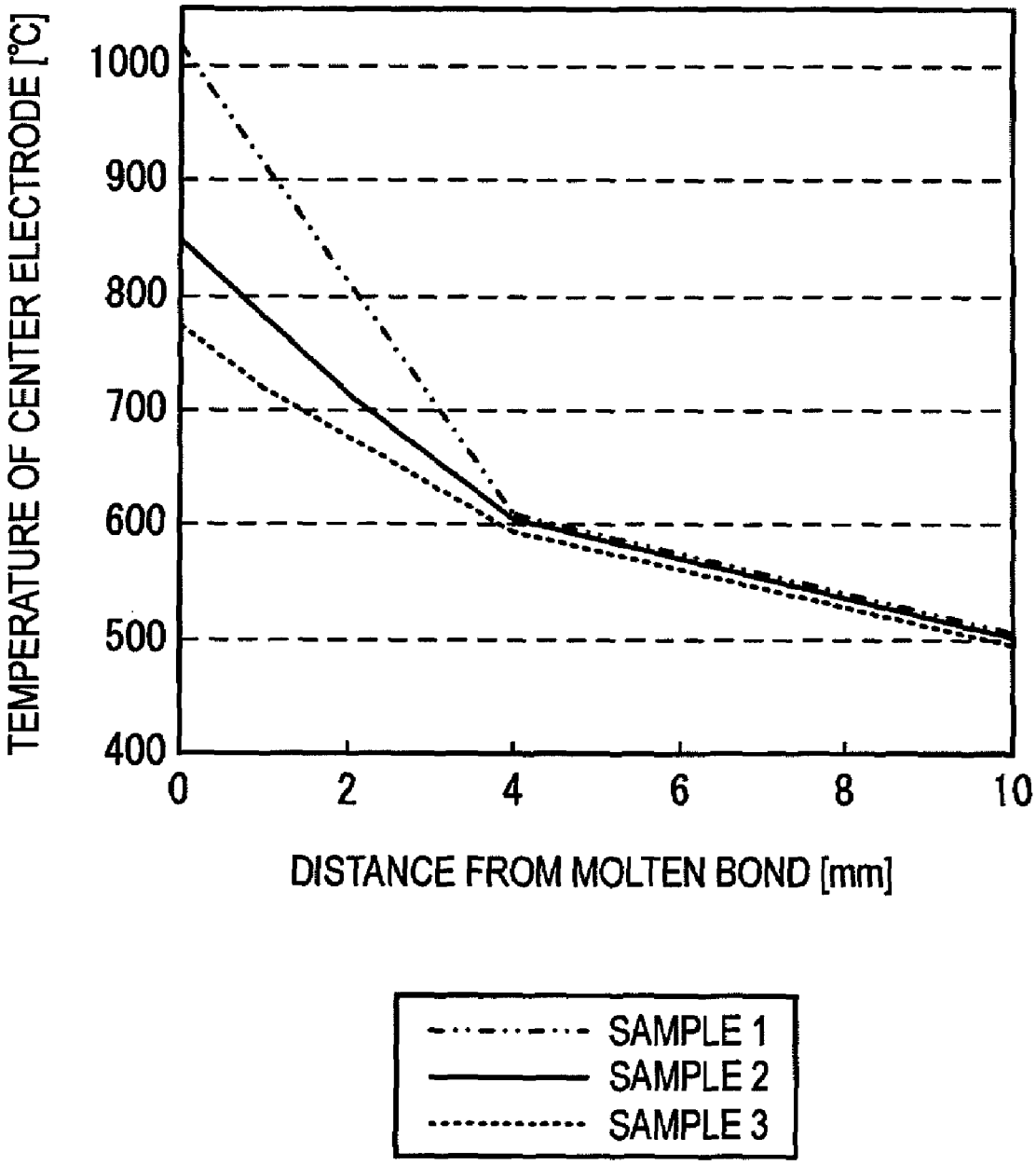
FIG. 6 is a graph which shows that the temperature distribution of the center electrode varies according to a difference in the ratio Vb/(Va+Vb) of the volume Vb of the core member of the center electrode.

Thereafter, a temperature probe was buried in each sample, each sample was then mounted in an actual vehicle to make a predetermined running test, and the temperature of various parts of the center electrode was measured. As a result of this evaluation test, as shown in FIG. 6, different temperature distributions of the center electrodes were obtained for the samples. As shown in FIG. 6, on the side closer to the base end of the plug than a point near the position 4 mm away from the base end of the molten bond, the center electrode of each sample showed almost the same temperature distribution. However, on the side closer to the leading end of the plug than the point near the position 4 mm away from the base end of the molten bond, the temperature of a part closer to the molten bond was confirmed to decrease in proportion to an increase in the ratio Vb/(Va+Vb). Also, the heat dissipation property improved in proportion to an increase in the volume of the core member contained in the center electrode, and hence a low temperature is shown. From the results of this evaluation test, the heat dissipation property of the center electrode was found to depend on the volume of core member contained on the side closer to the leading end of the plug than the point near the position 4 mm away from the base end of the molten bond. In the following examples, the volume Va of the electrode base member and the volume Vb of the core member are defined as volumes of respective members at a region from the base end of the molten bond to the position 4 mm away from the base end of the molten bond. Likewise an outer diameter at the position 4 mm away from the base end of the molten bond is used as the outer diameter d of the center electrode.

EXAMPLE 2

Next, an evaluation test was made on the relationship between the outer diameter d of the center electrode 20 at a position 4 mm away from the base end of the molten bond 95 and the heat dissipation property of the center electrode 20. Several kinds of center electrodes having different outer diameters d within the range of 1.5 mm to 2.6 mm were prepared. The number of each kind of the respective center electrodes was twelve. Samples of spark plugs using each kind of center electrode were produced. Thereafter, each sample was mounted in an engine, and an endurance test was made in which the state of maintaining the number of revolutions at 6000 rpm was continued for 700 hours using a 2.5-liter six-cylinder gasoline engine. Thereafter, the rate of occurrence of scooping (wearing or chipping) in the molten bond of each sample was examined. Here, scooping means a state in which the volume of the molten bond after an endurance test decreases, which is determined by measuring the volume of the molten bond before and after the endurance test by use of, for example, an X-ray CT apparatus. The rate of occurrence of scooping was calculated from the number of samples in which scooping occurred among twelve center electrodes having the same outer diameter d, and the relationship between the rate of occurrence of scooping and the outer diameter d was graphed (see FIG. 7).

Figure 7:
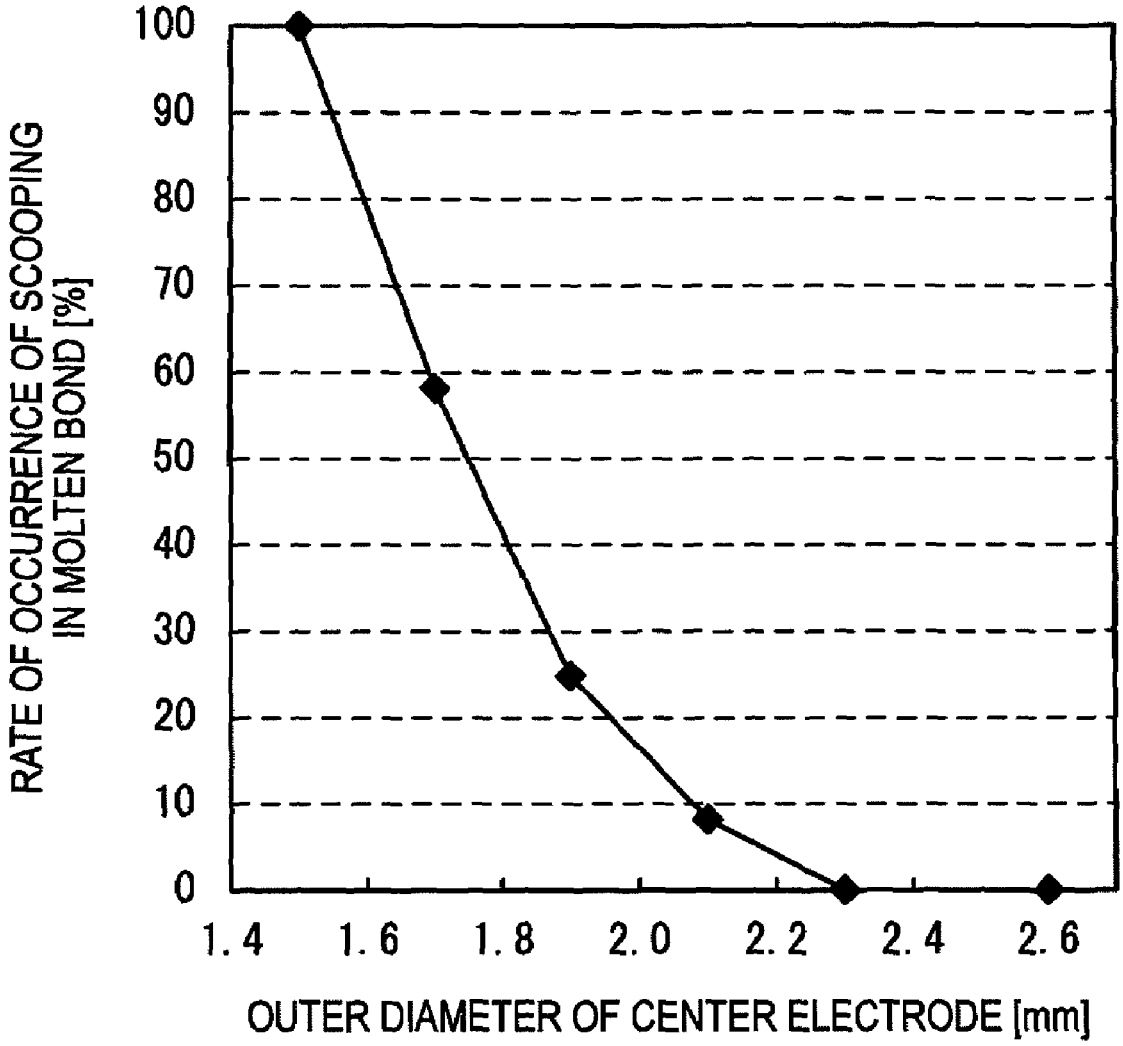
FIG. 7 is a graph which shows that the rate of occurrence of scooping in the molten bond varies depending on the outer diameter d of the center electrode.

As shown in FIG. 7, the sectional area of the core member in the direction of the axis line O was confirmed to decrease in proportion to a decrease in the outer diameter d of the center electrode. As a result, the heat dissipation property of conducting and releasing heat on the leading end side of the center electrode toward the base end side is lowered, and that the rate of occurrence of scooping rises if the outer diameter d of the center electrode is 2.1 mm or less.

EXAMPLE 3

Next, an evaluation test was made to examine the effect of temperature on the rate of occurrence of scooping in the molten bond 95. In this evaluation test, samples of center electrodes having an electrode tip joined thereto were prepared, and one thousand cycles were carried out, each cycle including: heating a molten bond for two minutes at a predetermined temperature; and thereafter naturally cooling the sample for one minute. In this test, ten samples were prepared for each temperature to be evaluated. The state of the molten bond of each sample that had been heated was confirmed, and the rate of occurrence of scooping was calculated for each evaluation temperature from the number of samples in which scooping was observed. As a result, the relationship between the rate of occurrence of scooping and the heating temperature was graphed (see FIG. 8).

Figure 8:
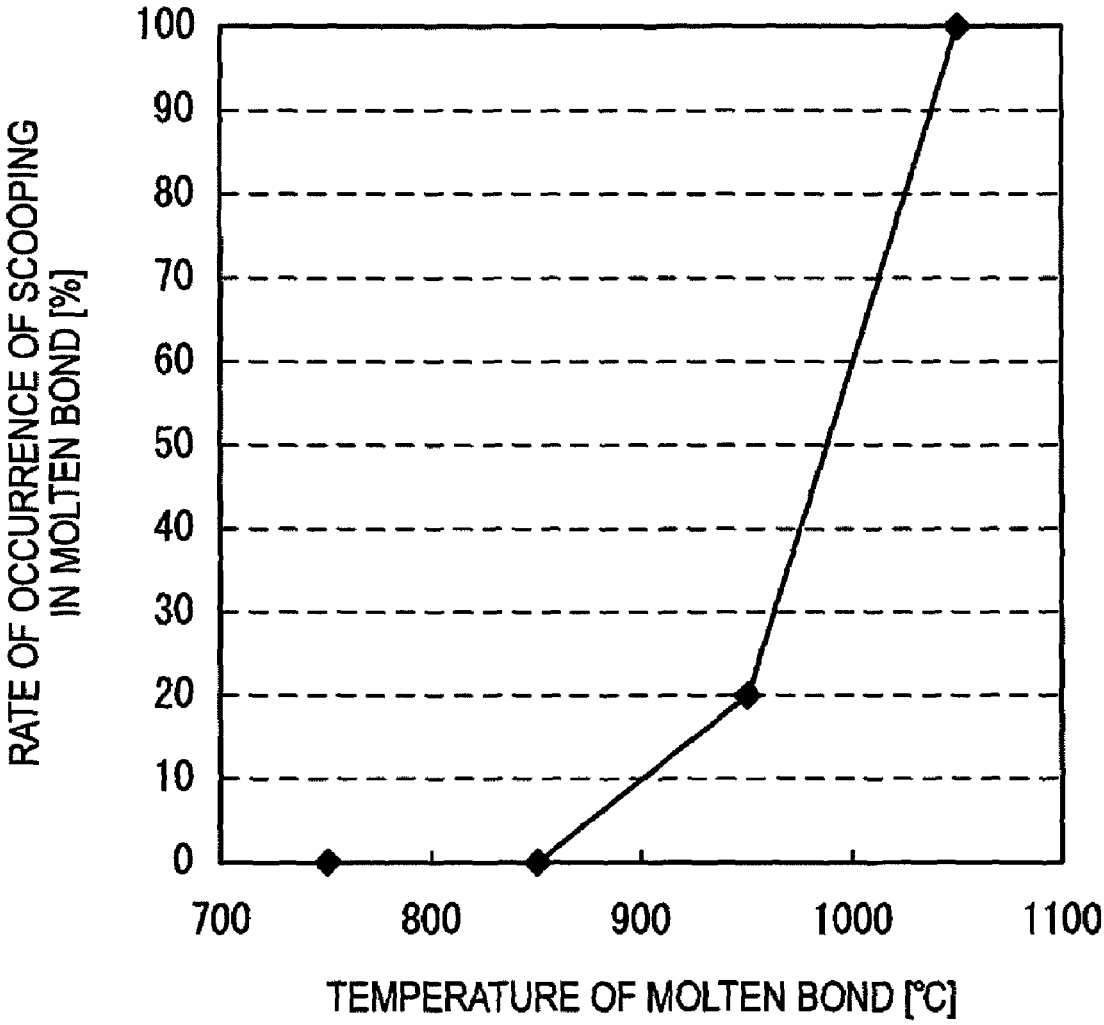
FIG. 8 is a graph which shows that the rate of occurrence of scooping in the molten bond varies depending on the temperature of the molten bond.

As shown in FIG. 8, the rate of occurrence of scooping was confirmed to increase in proportion to an increase in temperature of the molten bond, and the rate of occurrence of scooping sharply rose at a temperature of 950° C. or more.

EXAMPLE 4

From Examples 2 and 3, it is understood that, even if the outer diameter d of the center electrode 20 is 2.1 mm or less, the rise in the rate of occurrence of scooping can be suppressed if the temperature of the molten bond 95 is maintained at less than 950° C. Therefore, an evaluation test was made to determine a condition under which the temperature of the molten bond could be kept at less than 950° C. by a combination of the outer diameter d of the center electrode and the ratio Vb/(Va+Vb) of the volume Vb of the core member. In this evaluation test, a plurality of center electrodes were produced by a combination such that the ratio Vb/(Va+Vb) of the volume Vb of the core member ranged from 0.05 to 0.20 within the range of 1.5 mm to 2.1 mm in the outer diameter d of the center electrode. Spark plugs in each of which a temperature probe had been buried to measure the temperature of the molten bond were produced using these center electrodes. Each sample was mounted in an actual vehicle to make a predetermined running test, and the temperature of the molten bond was measured (see FIG. 9).

Figure 9:
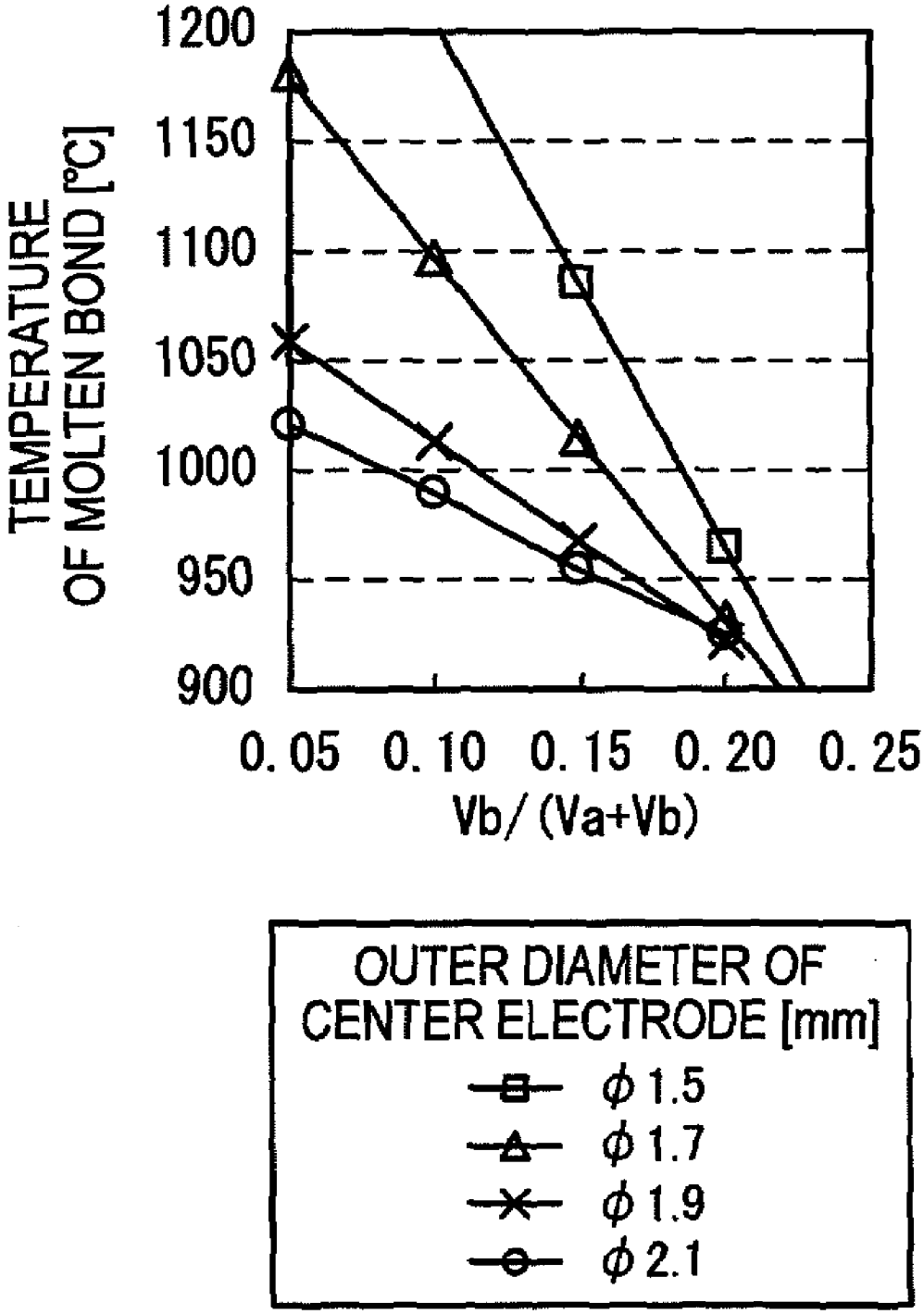
FIG. 9 is a graph which shows that the relationship between the ratio Vb/(Va+Vb) of the volume Vb of the core member of the center electrode and the temperature of the molten bond differs according to a difference in the outer diameter d of the center electrode.

In the result of this evaluation test, the relationship between the ratio Vb/(Va+Vb) and the temperature of the molten bond was confirmed by classifying the center electrodes into groups each of which had the same outer diameter d. As a result, as shown in FIG. 9, approximate straight lines were obtained which show that the temperature of the molten bond decreased in proportion to an increase in the ratio Vb/(Va+Vb), which lines have a different slope corresponding to an outer diameter d of the respective center electrodes. From this graph, a numerical expression concerning the relationship between the ratio Vb/(Va+Vb) and the outer diameter d was derived to determine a part at which the temperature of the molten bond is kept below 950° C. on each approximate straight line. As a result, the relational expression (1) described above was obtained.

EXAMPLE 5

A core member 25 made of copper or made of an alloy containing copper as a main component has a greater coefficient of linear expansion than an electrode base member 21 made of nickel or made of an alloy containing nickel as a main component. Also, internal stress becomes greater in proportion to an increase in the ratio Vb/(Va+Vb), namely, an increase in the volume Vb of the core member 25 contained in the electrode base member 21. Therefore, to examine the relationship between the ratio Vb/(Va+Vb) and the stress generated between the core member 25 and the electrode base member 21, an evaluation was made according to an FEM (Field Emission Microscopy) analysis.

Figure 10:
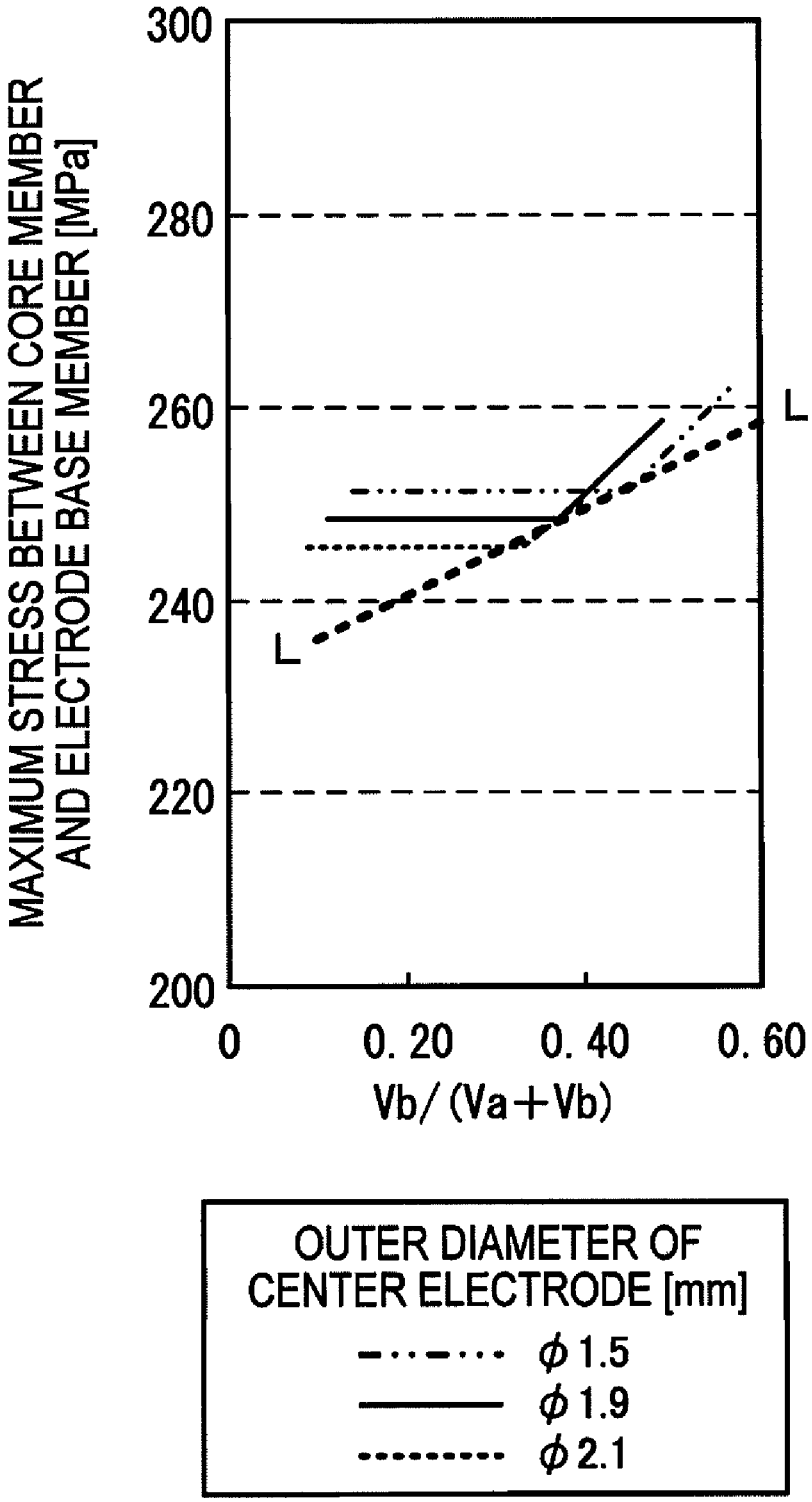
FIG. 10 is a graph which shows that the relationship between the ratio Vb/(Va+Vb) of the volume Vb of the core member of the center electrode and the maximum stress between the core member and the electrode base member differs according to a difference in the outer diameter d of the center electrode.

Simulation models of center electrodes having outer diameters d of 1.5 mm, 1.9 mm, and 2.1 mm, respectively, were produced. A calculation was then made to obtain the stress expected to be generated between the core member and the electrode base member when the ratio Vb/(Va+Vb) was gradually changed within the range of 0 to 0.60 in each model. This stress was determined as stress (maximum stress) in a part at which the greatest stress was generated in the boundary between the core member and the electrode base member. FIG. 10 is a graph of this analysis result.

As shown in FIG. 10, each model predicts that the maximum stress generated between the core member and the electrode base member has a fixed value until a certain point is reached, namely, when the ratio Vb/(Va+Vb) is gradually increased and where the maximum stress sharply rises when this point is exceeded. Therefore, a calculation was made to obtain an approximate straight line L-L (shown by the bold dotted line in FIG. 10) that joins points at which the maximum stress of each model abruptly increases in the graph of FIG. 10. In each model, the maximum stress generated between the core member and the electrode base member is constant in an area in which the value of Vb/(Va+Vb) is closer to the left end (in the graph) than the approximate straight line L-L, i.e., in an area in which the value of Vb/(Va+Vb) is smaller than at the point at which the maximum stress is abruptly increases. Based on this graph, the area closer to the left end than the approximate straight line L-L was derived from the relational expression of Vb/(Va+Vb) and d, and, as a result, the relational expression (2) described above was obtained.

EXAMPLE 6

Figure 11:
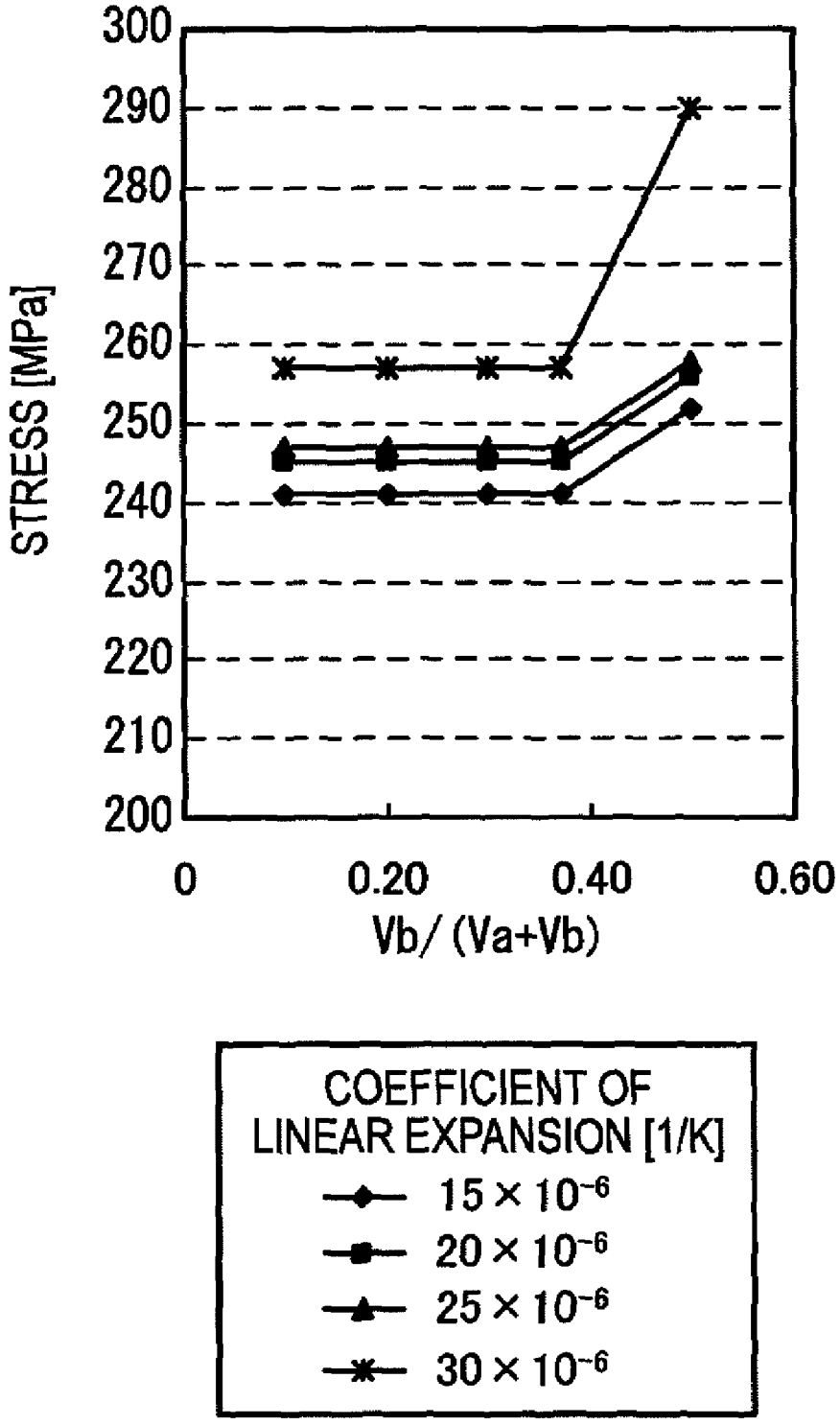
FIG. 11 is a graph which shows that the relationship between the ratio Vb/(Va+Vb) of the volume Vb of the core member of the center electrode and the maximum stress between the core member and the electrode base member differs according to a difference in coefficient of linear expansion of the core member.

Additionally, to examine the dependency of stress as a function of the ratio Vb/(Va+Vb) with a change in coefficient of linear expansion of the core member 25, and to examine stress that is expected to be generated between the core member 25 and the electrode base member 21, a FEM analysis was made in the same way as in Example 5. In this analysis, a plurality of simulation models of center electrodes having an outer diameter d of 1.9 mm were prepared, the models including core members having different coefficients of linear expansion at 800° C. within the range of $15\times10^{-6}$ to $30\times10^{-6}$ [1/K]. In each model, stress that is expected to be generated between the core member and the electrode base member when the ratio Vb/(Va+Vb) is gradually changed within the range of 0 to 0.60 was calculated. This stress was determined as the maximum stress in the boundary between the core member and the electrode base member in the same way as in the above-described example. FIG. 11 is a graph of this analysis result.

As shown in FIG. 11, the maximum stress between the core member and the electrode base member becomes larger as the coefficient of linear expansion increases. When the ratio Vb/(Va+Vb) falls below the borderline fixed by a value of approximately 0.40, each model indicates a substantially constant maximum stress. When the ratio Vb/(Va+Vb) of the volume Vb of the core member exceeds that borderline, the maximum stress becomes higher in proportion to an increase in the value of Vb/(Va+Vb) in each model. The model having a coefficient of linear expansion of $30\times10^{-6}$ [1/K] shows an increased rate in maximum stress (i.e., greater slope in the graph of FIG. 11) than the other models. Based thereon, the present inventors expect that the rise in internal stress generated when the center electrode receives heat can be suppressed by using a material whose coefficient of linear expansion at 800° C. is less than $25\times10^{-6}$ [1/K] as the core member.

EXAMPLE 7

The amount of heat received becomes larger in proportion to an increase in protrusion amount of the leading end portion 22 of the center electrode 20 or of the leading end portion 11 of the insulator 10 from the leading end surface 57 of the metal shell 50. Therefore, to effectively prevent scooping of the molten bond 95, a center electrode having an improved heat dissipation property is required. Therefore, an evaluation test was made as to how the relationship between the ratio Vb/(Va+Vb) and the temperature of the molten bond 95 is changed with a change in the protrusion length of the base end of the molten bond 95 from the leading end surface 57 of the metal shell 50, i.e., by a difference in distance "A" in the direction of the axis line O between the position of the base end of the molten bond 95 and the position of the leading end surface 57 of the metal shell 50 (see FIG. 2). In this evaluation test, samples of a plurality of spark plugs were prepared which were produced by a combination of a core member formed so that the ratio Vb/(Va+Vb) was varied within the range of 0.05 to 0.20 and a molten bond formed so that the base end of the molten bond protruded from the leading end surface of the metal shell within the range of −0.5 mm to 4 mm for a center electrode outer diameter d of 1.9 mm. A temperature probe was buried in each sample so as to measure the temperature of the molten bond. Thereafter, each sample was mounted in an actual vehicle, and the temperature of the molten bond was measured while making a predetermined running test (see FIG. 12).

Figure 12:
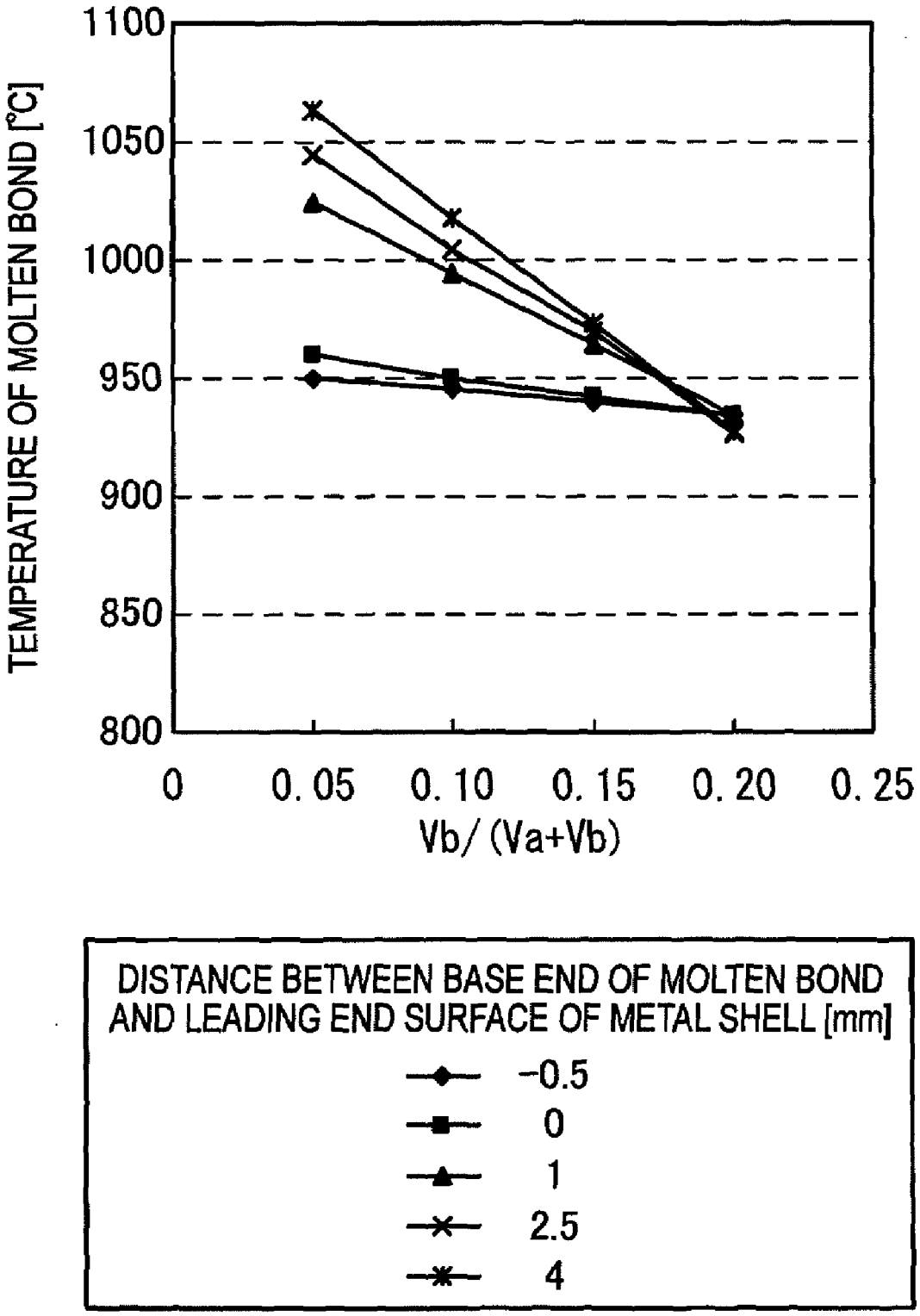
FIG. 12 is a graph which shows that the relationship between the ratio Vb/(Va+Vb) of the volume Vb of the core member of the center electrode and the temperature of the molten bond differs according to a difference in length in the axial direction between the leading end surface of the metal shell and the base end of the molten bond.

In the result of this evaluation test, relationships between the ratio Vb/(Va+Vb) and the temperature of the molten bond were confirmed by classifying these relationships into groups according to a difference in length (i.e., the distance "A" shown in FIG. 2) in the direction of the axis line O between the leading end surface of the metal shell and the base end of the molten bond. As a result, as shown in FIG. 12, approximate straight lines were obtained in which the temperature of the molten bond decreased in proportion to an increase in the ratio Vb/(Va+Vb). Further, the present inventors found the slope of each approximate straight line became steeper in proportion to an increase in length in the direction of the axis line O between the leading end surface of the metal shell and the base end of the molten bond. Still further, the present inventors found that a difference in the ratio Vb/(Va+Vb) did not cause a great difference in the temperature of the molten bond, and that the temperature could be kept without substantial change at approximately 950° C. in those samples having a length of less than 1 mm in the direction of the axis line O between the leading end surface of the metal shell and the base end of the molten bond. On the other hand, the temperature of the molten bond could be controlled to become lower in proportion to an increase in the ratio Vb/(Va+Vb) in those samples having a length of 1 mm or more. In other words, it was found that, if the position of the base end of the molten bond is located 1 mm or more closer to the leading end of the plug in the direction of the axis line O than the position of the leading end surface of the metal shell, the heat dissipation property of the center electrode can be improved, and a highly advantageous effect can be obtained using a center electrode in which the relationship between the ratio Vb/(Va+Vb) and the outer diameter d of the center electrode is fixed according to the above-described relationships (1) and (2).

EXAMPLE 8

Next, an evaluation test was made of how the temperature of the molten bond 95 varies with a change in the distance B (see FIG. 2) between the base end of the molten bond 95 and the leading end of the core member 25 in the direction of the axial line O. In the evaluation test, a plurality of spark plug samples were prepared. The samples had an outer dimension d of 1.9 mm, a ratio Vb/(Va+Vb) of 0.26, and different distances B (see FIG. 2) between the base end of the molten bond 95 and the leading end of the core member 25 in the direction of the axial line O within a range from 0 to 0.9 mm. A temperature probe was buried in each sample, each sample was then mounted in an actual vehicle to make a predetermined running test, and the temperature of the molten bond was measured (see FIG. 13).

Figure 13:
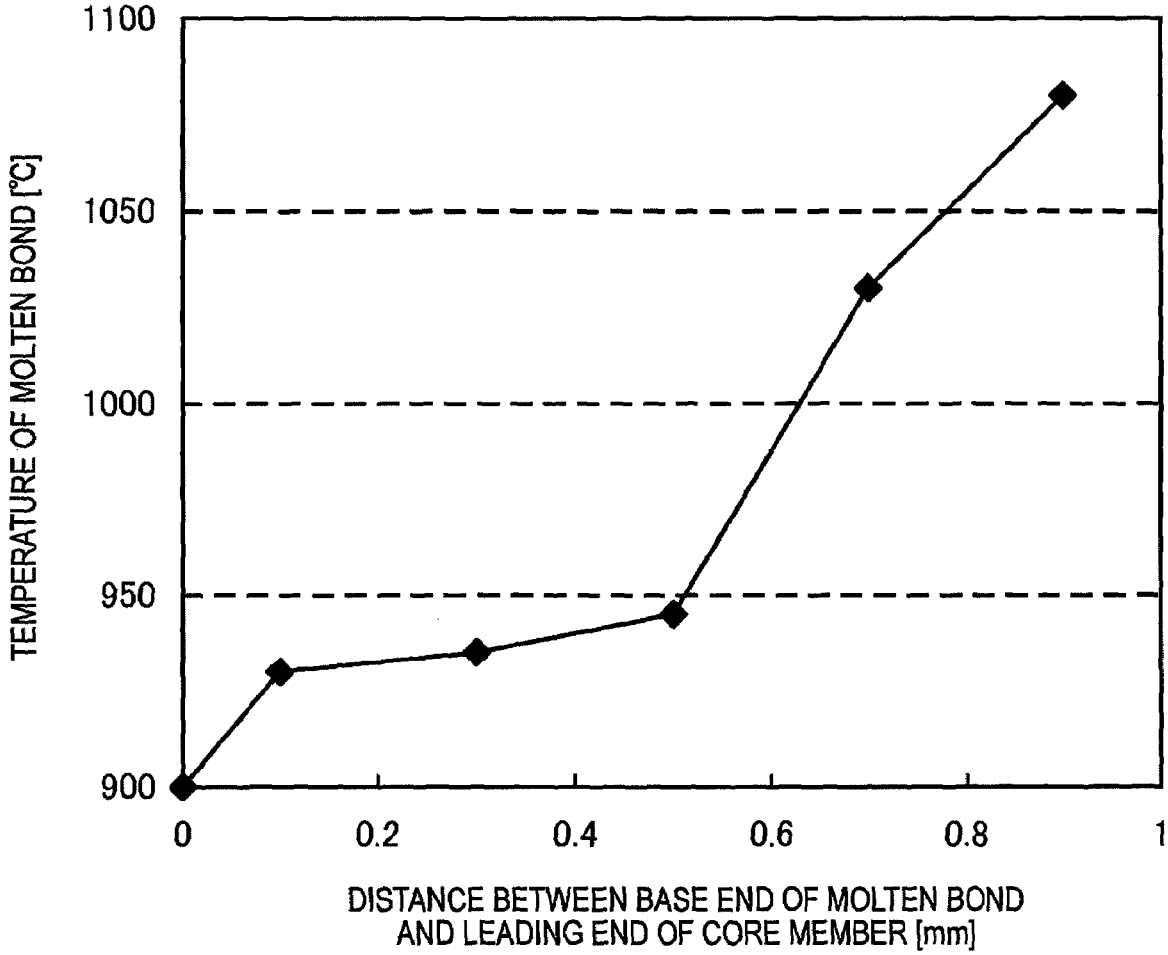
FIG. 13 is a graph illustrating the change in temperature of molten bond as a function of the distance between the base end of the molten bond and the leading end of the core member in the axial direction.

As shown in FIG. 13, the present inventors found that the temperature of molten bond decreased as the difference in the distance B (see FIG. 2) between the base end of the molten bond 95 and the leading end of the core member 25 in the direction of the axial line O decreased, and when the distance B was 0.5 mm or less, the temperature of the molten bond 95 suddenly decreased to a temperature of less than 950° C. That is, the present inventors found that further improved dissipation property of the center electrode can be obtained when the distance B between the base end of the molten bond and the leading end of the core member 25 in the direction of the axial line O is set at 0.5 mm or less.

The present invention can be variously modified. For example, the material of the electrode base member 21 and the material of the core member 25 that are components of the center electrode 20 are nickel or an alloy containing nickel as a main component and copper or an alloy containing copper as a main component, respectively. However, metallic materials other than the above-mentioned metallic materials may be used for the electrode base member 21 and the core member 25. For example, metal (e.g., Fe alloy) superior in spark wear resistance and metal (e.g., Ag alloy) having a higher thermal conductance than the electrode base member 21 may be used in combination.

Although the above description was given according to an embodiment of the present invention, the present invention is not limited thereto. It is a matter of course that various modes of carrying out the principles disclosed herein may be adopted without departing from the spirit and scope of the claims appended hereto.

This application is based on Japanese Patent Application No. 2007-301852 filed Nov. 21, 2007, the above application incorporated herein by reference in its entirety.

What is claimed is:

1. A spark plug comprising:

a center electrode extending from a leading end thereof to a base end thereof in an axial direction and comprising an electrode base member and a core member disposed inside the electrode base member, the core member having a thermal conductance higher than that of the electrode base member;

an electrode tip containing a noble metal as a main component, the electrode tip being joined to a leading end portion of the center electrode via a molten bond in which the electrode tip and the center electrode are fused, the molten bond extending from a leading end thereof to a base end thereof in the axial direction;

an insulator having an axial hole extending in the axial direction, the insulator holding the center electrode in the axial hole on a leading end side portion of the axial hole;

a metal shell extending from a leading end thereof to a base end thereof in the axial direction and surrounding and holding a radial periphery of the insulator; and a ground electrode having one end joined to a leading end surface of the metal shell and another end defining a spark discharge gap between the electrode tip and the ground electrode;

wherein following relationships (1) are (2) are satisfied:

$$d \leqq 2.1 \text{ [mm]} \quad (1); \text{ and}$$

$$-0.09 \times d + 0.33 < Vb/(Va+Vb) < -0.2 \times d + 0.75 \quad (2)$$

where:

d is an outer diameter of the center electrode at a position 4 mm closer to the base end of the center electrode from the base end of the molten bond in the axial direction;

Va is a volume of the electrode base member in a region from the base end of the molten bond to a position of the center electrode 4 mm closer to the base end of the center electrode from the base end of the molten bond in the axial direction; and Vb is a volume of the core member in a region from the base end of the molten bond to a position 4 mm closer to the base end of the center electrode from the base end of the molten bond in the axial direction.

2. The spark plug according to claim 1, wherein the core member of the center electrode has a linear expansion coefficient of $25\times10^{-6}$ [1/K] or less at 800° C.

3. The spark plug according to claim 1, wherein the base end of the molten bond is located 1 mm or more closer to the leading end of the center electrode than the leading end surface of the metal shell in the axial direction.

4. The spark plug according to claim 1, wherein a distance defined between the base end of the molten bond and a leading end of the core member in the axial direction is 0.5 mm or less.

5. The spark plug according to claim 1, wherein an outer circumferential surface of the metal shell has a fixing screw portion, the fixing screw portion having a threaded portion to be screwed into an internally threaded fixing screw hole of an internal combustion engine, and wherein the fixing screw portion has a nominal diameter of 12 mm or less.

* * * * *